US005340082A

United States Patent [19]

Holloway

[11] Patent Number: 5,340,082

[45] Date of Patent: Aug. 23, 1994

[54] PORTABLE SURFACE LIFT FOR A VEHICLE

[75] Inventor: James A. Holloway, Olive Branch, Miss.

[73] Assignee: Delaware Capital Formation, Inc., Wilmington, Del.

[21] Appl. No.: 860,187

[22] Filed: Mar. 30, 1992

[51] Int. Cl.[5] ..... B66F 7/22

[52] U.S. Cl. ..... 254/88; 254/9 C; 254/10 C; 254/90; 254/89 H; 254/124; 254/93 L; 187/8.43; 187/8.41

[58] Field of Search ..... 254/88, 2 R, 2 B, 10 R, 254/10 B, 10 C, 9 R, 9 B, 9 C, 8 C, 124, 90, 89 R, 89 H, 93 L, DIG. 9; 187/8.43, 8.41, 8.67

[56] References Cited

U.S. PATENT DOCUMENTS

| | | | |
|---|---|---|---|
| 2,860,852 | 11/1958 | Lewis | 254/10 B |
| 3,117,765 | 1/1964 | Chiuzzi | 254/10 |
| 3,317,004 | 5/1967 | Harrison | 187/8.5 |
| 3,689,030 | 9/1972 | Backus | 254/93 R |
| 4,238,114 | 12/1980 | Migliorati | 254/88 |
| 4,445,665 | 5/1984 | Cray | 254/88 |
| 4,901,980 | 2/1990 | Hansen | 254/9 |
| 5,025,892 | 6/1991 | Stelzl | 187/8.72 |

OTHER PUBLICATIONS

Rotary Lift, A Dover Industries Co.,. "The PFX and PAL7 Do Wonders For Brake and Tire Work" (United States 1991).

Rotary Lift, A Dover Industries Col, "Don't Stoop to This" (United States 1991).

*Primary Examiner*—Bruce M. Kisliuk
*Assistant Examiner*—Eileen P. Morgan
*Attorney, Agent, or Firm*—Walker, McKenzie & Walker

[57] ABSTRACT

A portable surface lift for a vehicle and a pair of manually retractable wheels respectively attached to a mid-portion of opposite sides of the lift for rolling the lift over a garage floor surface when the vehicle is not lifted on the lift. The lift has fixed pads for contact with the undercarriage of the vehicle, and a hydraulic cylinder raises and lowers the vehicle on the lift. Arms are pivotally attached to opposite sides of the lift with a wheel at the end thereof for manual movement between a wheel-retracted position and a wheel-extended position. The wheels remain in the extended position by an over-center pivoting design. Two towing mechanisms are provided for moving the lift: a towing bar that can be attached to a towing bracket on an end of the lift, or a wheeled towing dolly having a clevis and securing pin for attachment to the towing bracket. The lift has a safety locking mechanism for securing the lift in various raised positions.

2 Claims, 3 Drawing Sheets

FIG. 1
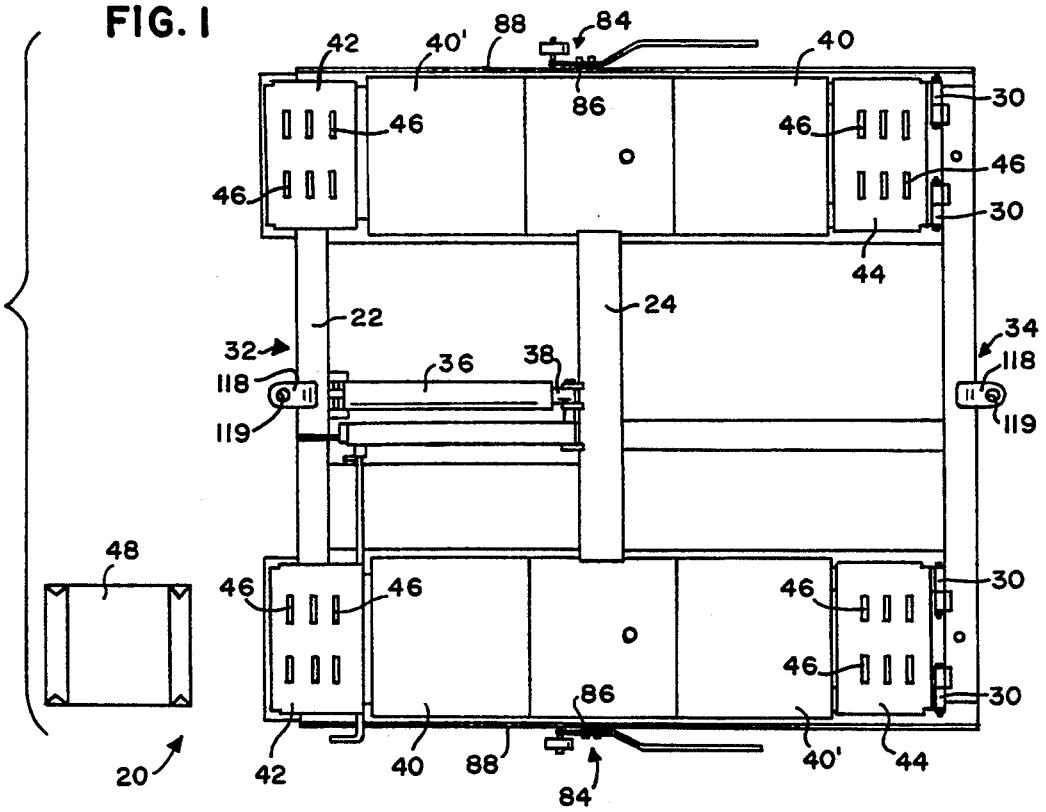
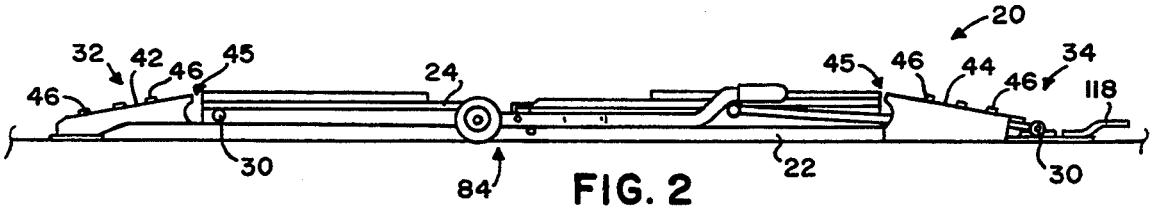
FIG. 2
FIG. 4
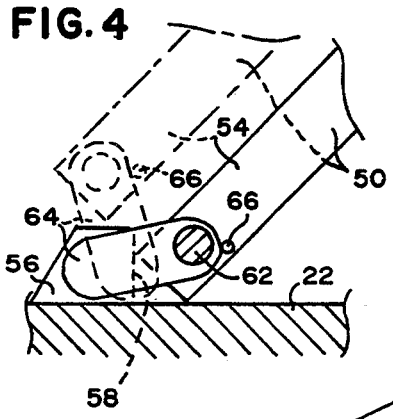
FIG. 3
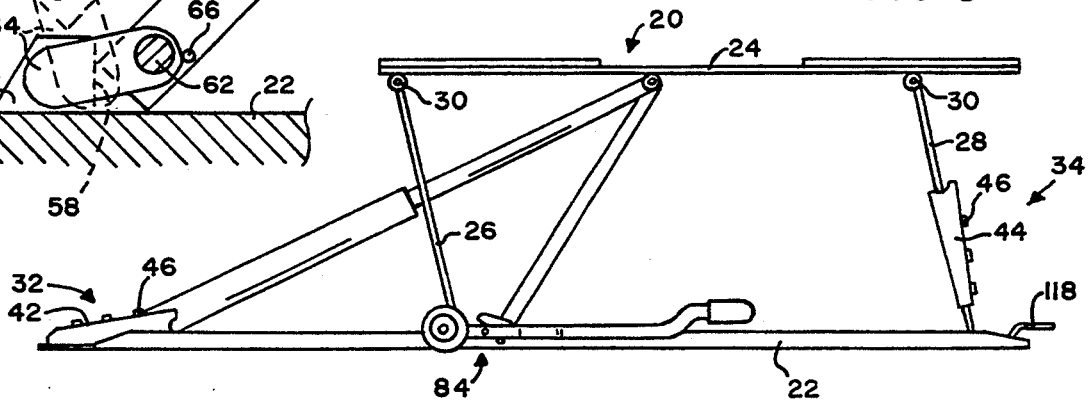

PORTABLE SURFACE LIFT FOR A VEHICLE

BACKGROUND OF THE INVENTION

1. Field of the Invention

The present invention relates, in general, to lifts for vehicles, and in particular, to low-rise surface lifts for vehicles.

2. Description of the Related Art

Establishments or shops where vehicles, such as cars, trucks, and the like, are serviced often need to raise the vehicles from the surface of the shop floor to facilitate the tasks to be performed by a service attendant or mechanic. In many applications, such as vehicle body repair, tire rotation, brake servicing, as well as new and used vehicle preparation and reconditioning, the desired height that a vehicle must be lifted is quite limited, i.e., only to the waist or chest of the repair person. For such applications, use of a "low-rise" surface-mounted lift, as distinguished from a hydraulic lift with a below-ground buried lifting cylinder, is well-known. Such surface-mounted low-rise lifts are typically bolted to the surface of the floor of a service bay in a garage.

At least two varieties of surface-mounted lifts employing a low-rise parallelogram design are well-known. The first variety has adjustable arms and pads for contact with the undercarriage of a vehicle. A representative well-known example of such a surface-mounted low-rise lift is the model PAL7 surface-mounted low-rise parallelogram lift manufactured and sold for many years by Rotary Lift Company, Memphis, Tenn. The PAL7 lift is designed with parallel front and rear supporting legs pivotally attached to a base and a superstructure, with a hydraulic cylinder that raises and lowers the superstructure and associated vehicle support arms.

A second variety of surface-mounted lift employing a low-rise parallelogram design has no adjustable arms and pads, but instead has four fixed pads, one pair forward and one pair rearward, attached to a superstructure that can be raised and lowered. Such a lift is typically used in high-volume tire stores or brake maintenance facilities, and allows faster operation than a lift with adjustable arms and pads that must be correctly positioned for each vehicle. A representative well-known example of this second variety lift is the model PFX surface-mounted low-rise parallelogram lift manufactured and sold for many years by Rotary Lift Company, Memphis, Tenn. The PFX lift is designed with parallel front and rear supporting legs pivotally attached to a base and a superstructure, with a hydraulic cylinder that raises and lowers the superstructure and associated fixed pads, attached thereto, that contact the undercarriage or rocker panels of a vehicle.

However, as such surface-mounted lifts are bolted to the floor of the garage bay, their use is limited to "dedicated bay" applications. A significant capital investment, sufficient to outfit each garage bay with its own dedicated and permanently mounted lift, has been heretofore required by the buyer of surface-mounted lifts.

It is therefore desirable to have a portable surface lift for a vehicle that may be easily moved from garage bay to garage bay, as required, thereby reducing the number of surface lifts required by a given establishment, yet which remains stable beneath a vehicle when in use. Rather than requiring wheels to be attached and removed every time the lift is moved, the lift should be able to be moved into place, yet remain safely in position and not move when lifting the vehicle. Preferably, no substantial effort should be required to raise the lift from the garage surface, and the only effort required to transport the lift should be that necessary to overcome the inertia of the lift itself. It is also desirable to have manual towing means removable from the lift for moving the lift from one location to another.

SUMMARY OF THE INVENTION

The present invention is, in combination, a portable surface lift for a vehicle and a pair of manually retractable wheel means respectively attached to a mid-portion of opposite sides of the lift for rolling movement of the lift over a garage floor surface. Each wheel means includes an arm pivotally attached to its respective side of the lift, said arm having a handgrip portion at one end and a wheel rotatably attached to the other. The arm pivots the wheel into an "over-center" position for raising and supporting the lift for transport. Additionally, the present invention may include one of a variety of towing means, removably attachable to an end of the lift, for causing the lift to be rollingly moved by manual towing or pushing.

It is an object of the present invention to provide portability for a surface vehicle lift. It is also desirable, for safety reasons, that the lift not be prone to movement over the surface on which the lift rests when a vehicle is lifted thereon. It is a further object that removable towing means be provided for moving the lift over its resting surface, and that the towing means preferably be attachable and detachable from the lift.

BRIEF DESCRIPTION OF THE DRAWINGS

FIG. 1 is a plan view of the portable surface lift of the present invention.

FIG. 2 is a side elevational view of the portable surface lift of the present invention shown in its lowered or collapsed position.

FIG. 3 is a side elevational view, similar to FIG. 2, but with the portable surface lift shown in a raised position.

FIG. 4 is a side sectional view through the locking latch release handle of the portable surface lift, showing the movement of the cam leg at the end of the locking leg, taken substantially along the line 4—4 shown in FIG. 5.

FIG. 1 is a side sectional view showing the towing bar engaged with the towing bracket.

DESCRIPTION OF THE PREFERRED EMBODIMENT

Figure 5:
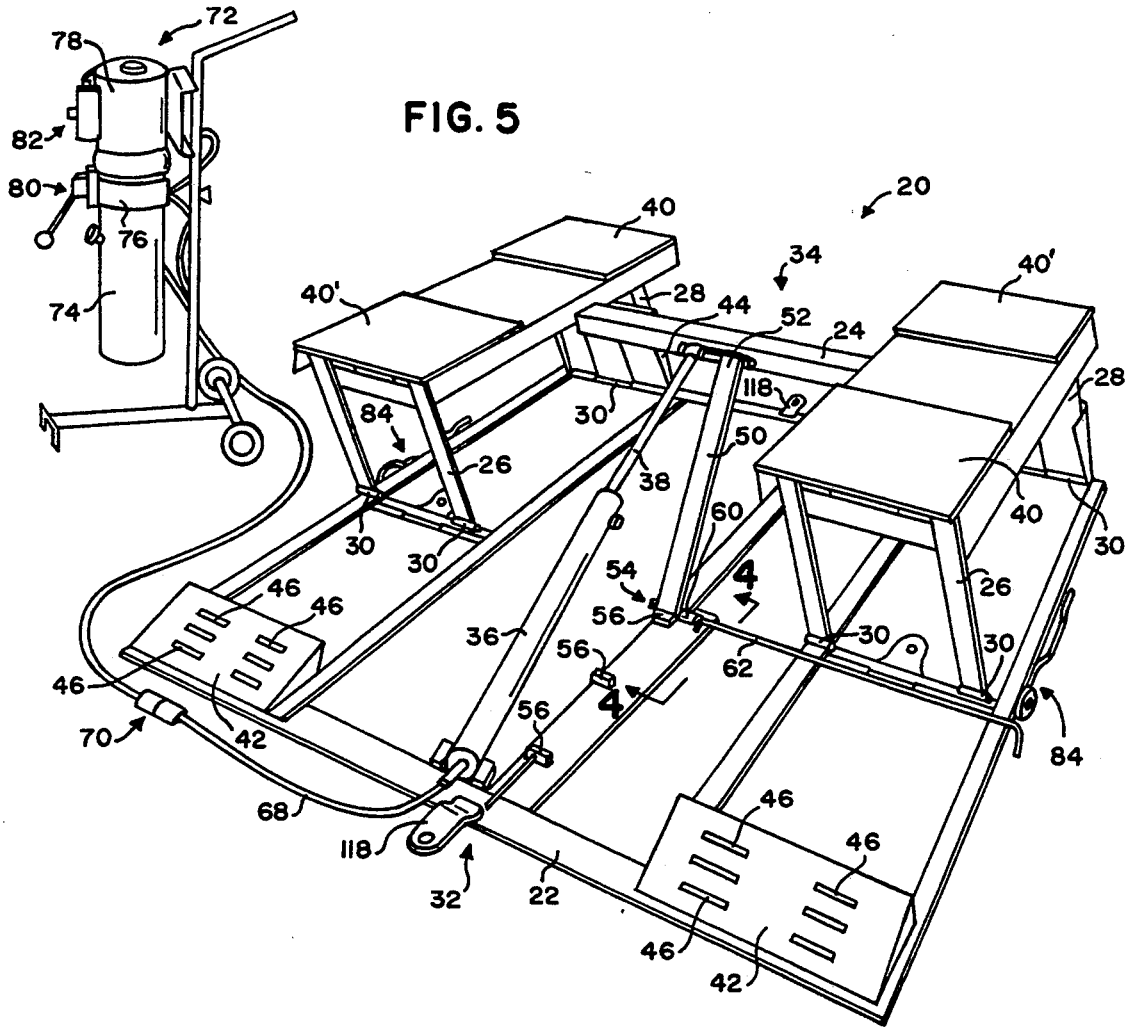
FIG. 5 is a perspective view of the portable surface lift in the raised position and attached to a portable power unit.

Referring to FIGS. 1, 2, 3, and 5, the portable surface lift 20 is seen to comprise a base 22, a superstructure 24, plus front and rear legs 26, 28 pivotally attached using hinge bushings 30 at either ends thereof to base 22 and superstructure 24, thereby forming a parallelogram. For reference purposes, lift 20 will be understood to have a front end 32 and a rear end 34, corresponding to the front and rear ends, respectively, of a vehicle to be supported by lift 20. A hydraulic cylinder 36 having a piston or cylinder rod 38 is pivotally attached between base 22 and superstructure 24 to cause raising and lowering of superstructure 24 in response to the extension and retraction of cylinder rod 38 in a manner well-known to those skilled in the art. The parallelogram design geometry of lift 20 is understood to cause superstructure 24 to remain substantially parallel to base 22 at all times.

Superstructure 24 typically has four nonadjustable rectangular rubber pads 40, 40′ bondedly attached to superstructure 24 for contacting and lifting the undercarriage or rocker panels of a vehicle on the lift. Such a lift with nonadjustable pads is known in the trade as a "fixed-pad" lift, as distinguished from one having adjustable swivel arms with contact pads thereon.

Fixed rubber pads 40, 40′ are designed to fit under the rocker panels of a vehicle to be lifted, and matingly and liftingly contact the underside of the vehicle. Preferably, two of the pads, 40′, which will be positioned adjacent the catalytic converter of the vehicle, will have a high temperature rubber coating or be constructed of heat resistant materials, to prevent damage from placement near the heated catalytic converter.

Lift 20 also has four ramps, a pair of forward ramps 42 and a pair of rearward ramps 44. Forward ramps 42 are spaced apart from each other to match the wheel spacing of a vehicle and are wide enough to accommodate the various wheel spacings of various typical vehicles. Rearward ramps 44 are similarly spaced apart from each other and are of compatible widths with forward ramps 42. Forward ramps 42 are fixedly attached, as by welding, to base 22. Rearward ramps 44 are fixedly attached, as by welding, to rear legs 28 and cover rear legs 28 when superstructure 24 is in the lowered position shown in FIGS. 1 and 2. A slight gap 45 may exist between ramps 42, 44 and superstructure 24 when lift 20 is in the lowered position.

Both pairs of front and rear ramps 42, 44 preferably have upward-facing louvers 46 to increase the traction between a vehicle's wheels and ramps 42, 44. In practice, a vehicle is driven up and over rear ramps 44, over pads 40 and 40′, and comes to rest with a front wheel resting in wheel spotting dish 48. The vehicle will be straddling the lift, with its front wheels past the front end 32 of the lift and with its rear wheels past the rear end 34 of the lift, and superstructure 24 will then be raised, lifting the vehicle in the well-known manner. The advantage of a "fixed-pad" lift over a lift with adjustable swivel arms is the increased throughput possible with a fixed-pad lift because a mechanic does not have to walk around the lift, adjusting swivel arms to properly contact the vehicle. After the vehicle has been serviced upon the lift, the lift will be lowered and the vehicle will be driven back up and over the ramps and off the lift, in a manner that will now be apparent.

Turning to FIG. 5, lift 20 also has, for safety reasons, a locking leg 50 hingedly attached at one end 52 to superstructure 24 and slidably resting at the other end 54 upon base 22. One or more stop blocks 56 are fixedly attached, as by welding, to base 22 in the sliding path of end 54. As superstructure 24 is raised by hydraulic cylinder 36, end 54 of locking leg 50 will be dragged up and over each stop block 56 in a manner that will now be apparent. However, it will be understood that locking leg 50 will prevent superstructure 24 from lowering when end 54 abuts against edge 58 of a stop block 56 as shown in detail in FIG. 4.

Fixedly attached, as by welding, to the lower end 54 of locking leg 50, is a sleeve 60. Rotatably attached through sleeve 60 is a locking latch release handle 62 having a fixedly attached cam leg 64 radially extending therefrom adjacent sleeve 60. When the operator of lift 20 desires to lower superstructure 24, locking latch release handle 62 will be turned counterclockwise so that cam leg 64 lifts end 54 of locking leg 50 over stop block 56 as shown in FIG. 4 in dashed outline. A stop 66 extends outwardly from locking leg 50 for allowing cam leg 64 to rest in an over-center locking position, thereby holding end 54 of locking leg 50 above stop block 56 during lowering of superstructure 24. When superstructure 24 is again raised, cam leg 64 will rotate clockwise and allow end 54 of locking leg 50 to drop to base 22, for contact with stop blocks 56, in a manner that will now be apparent.

Referring to FIG. 5, hydraulic cylinder 36 is connected, as by hose 68 having well-known quick disconnect couplings 70, to a portable power unit 72. Power unit 72 includes a hydraulic fluid reservoir 74 and a hydraulic pump 76 driven by an air or electric motor 78. Typically, motor 78 will be air driven for safety in environments having flammable solvents or paints. Various valves 80 and switches 82 control pump 76 and motor 78 for operating hydraulic cylinder 36 in a manner well-known to those skilled in the art.

For portability, lift 20 includes a pair of manually retractable wheel means 84 respectively attached to a mid-portion 86 of opposite sides 88 of lift 20 for rolling movement of lift 20 over garage floor surface S. Preferably the point of attachment of wheel means 84 to sides 88 is chosen so as to approximately balance the weight of front and rear ends 32, 34 upon wheel means 84 when lift 20 is in the lowered position and wheel means 84 supportingly raises lift 20 from surface S for rolling movement thereover in a manner hereinafter described.

Figure 7:
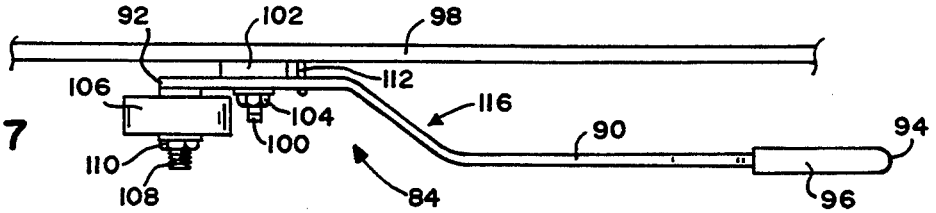
FIG. 7 is a top view of one of the wheel means, shown in the wheel-retracted position.
Figure 8:
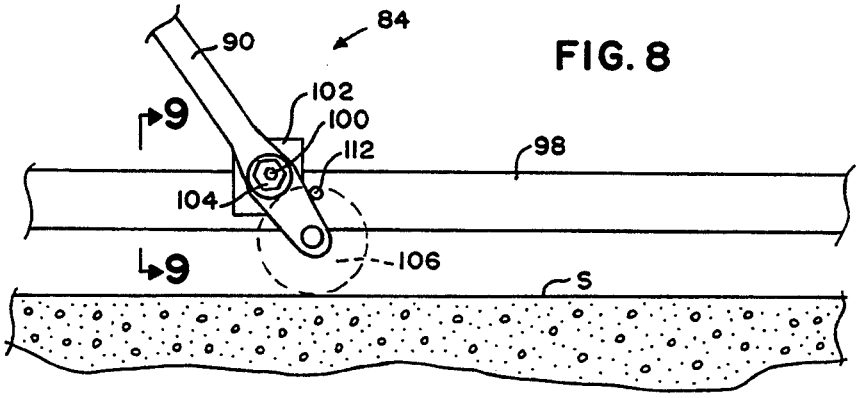
FIG. 8 is a partial side elevational view of one of the wheel means, with the wheel removed and shown in dashed outline for clarity, shown in the wheel-extended position.
Figure 9:
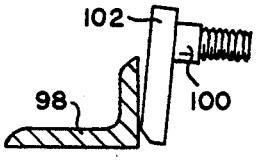
FIG. 9 is a sectional view of the pivotal attachment for the arm of the wheel means, taken along the line 9—9 shown in FIG. 8, with the arm removed.

Referring to FIGS. 6–9, the details of the preferred embodiment of wheel means 84 are shown. Each wheel means 84 includes an arm 90 having a first end 92 and a second end 94. Arm 90 is pivotally attached to its respective side 88 between first and second ends 92, 94, and has a handgrip portion 96, preferably covered with rubber or plastic for improved and comfortable gripping, adjacent second end 94. Referring to FIG. 9, arm 90 is preferably pivotally attached to a side rail 98 of side 88 of base 22 upon a threaded pivot stud 100 secured and preferably welded to a plate 102 that, in turn, is securely attached, preferably welded, to side rail 98, at a slight camber angle. A nut and washer 104 retain arm 90 on stud 100.

Each wheel means 84 further includes a wheel 106 rotatably attached to first end 92 of arm 90, preferably upon threaded axle stud 108 securely attached, preferably welded, to end 92 and perpendicular to arm 90. A nut and washer 110 retain wheel 106 upon axle stud 108. Each wheel 106 may have a bearing, not shown, axially inserted therethrough for reducing the rotational friction of wheel 106 about axle stud 108.

Figure 6:
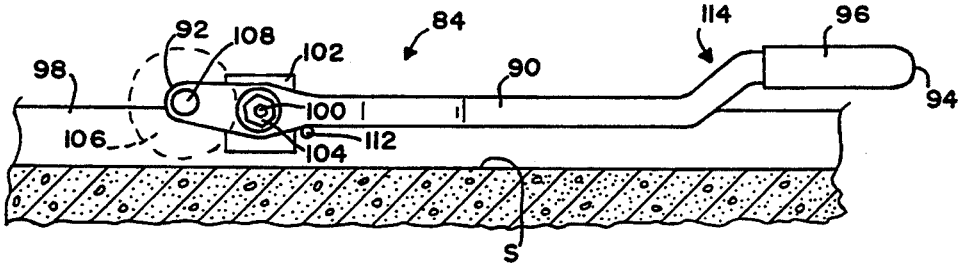
FIG. 6 is a side elevational view of one of the wheel means, with the wheel removed and shown in dashed outline for clarity, shown in the wheel-retracted position.

Arm 90 has a wheel-retracted position, shown in FIG. 6, in which lift 20 rests upon garage floor surface S, and also has a wheel-extended position, shown in FIG. 8, in which wheel 106 is in contact with surface S and in which wheel means 84 supportingly raises lift 20 from surface S for rolling movement thereover. Preferably, as am 90 moves from the wheel-retracted position into the wheel-extended position, wheel 106 moves under and past arm 90's point of pivotal attachment to side 88, i.e., pivot stud 100, into an over-center orientation in which arm 90 rests against a stop means or pin 112, outwardly extending from side 88 adjacent the pivotal attachment of arm 90 to side 88, for retaining arm 90 from movement past the wheel-extended position. It will be understood that arm 90 will tend to remain in the wheel-extended position by the forces of gravity acting on lift 20 against the over-center orientation of wheel 106. Preferably, stop means 112 is also positioned as shown in FIG. 6 to serve the dual purpose of retaining arm 90 from movement past the wheel-retracted position.

For ease of gripping handgrip portion 96 when arm 90 is in the wheel-retracted position, each arm 90 may have first and second bended regions 114 and 116, respectively, shown in FIGS. 6 and 7. Handgrip portion 96 is vertically offset from surface S by first bended region 114 in am 90 between handgrip portion 96 and the point of pivotal attachment of arm 90 to its respective side 88 of lift 20. Furthermore, handgrip portion 96 is horizontally offset from lift 20 by second bended region 116 in arm 90 between handgrip portion 96 and the aforementioned point of pivotal attachment of arm 90. It shall be understood that, while the preferred embodiment is constructed as shown with separate first and second bended regions for ease of manufacture, each respectively in the vertical plane and horizontal plane, the two regions could be combined into a single bended region, through a plane at approximately forty-five degrees to the vertical, in a manner that will now be apparent, giving an equivalent placement of handgrip portion 96 with respect to surface S and side For towing lift 20 across the garage floor surface, one of a variety of towing means may be provided for removable attachment to an end of the lift. The term "towing," as used herein, shall be understood to encompass both pushing and pulling of lift 20 across the garage floor surface. A towing bracket 118 having a hole 119 therethrough is fixedly attached, as by welding, to lift 20 at an end thereof for removable engagement with the towing means. Preferably, towing brackets 118 are attached to both front and rear ends 32, 34 of lift 20 for ease of accessibility and use, it being somewhat easier to pull lift 20 than to push it.

Figure 10:
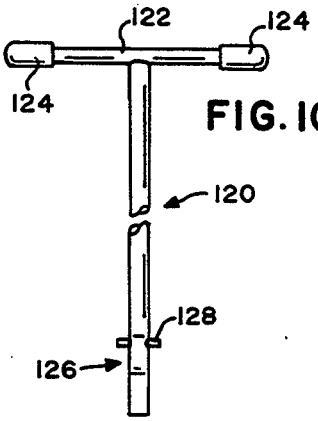
FIG. 10 is a front view of the towing bar of the present invention.
Figure 11:
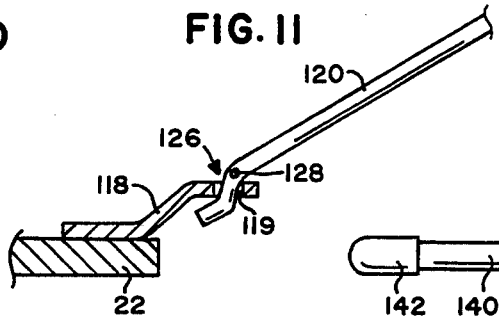

In the first embodiment shown in FIGS. 10 and 11, the towing means is selected to be a towing bar 120. Towing bar 120 includes a handle 122 attached at one end thereof, preferably with rubber or plastic handgrips 124, and a bended portion 126 at the other end. Preferably, bended portion 126 is "S"-shaped as shown for hooking engagement with hole 119 in bracket 118 as shown in FIG. 11. Towing bar 120 also may include a transverse pin means 128 adjacent bended portion 126 for limiting the insertion of bended portion 126 through hole 119 in towing bracket 118 in a manner that will now be apparent.

Figure 13:
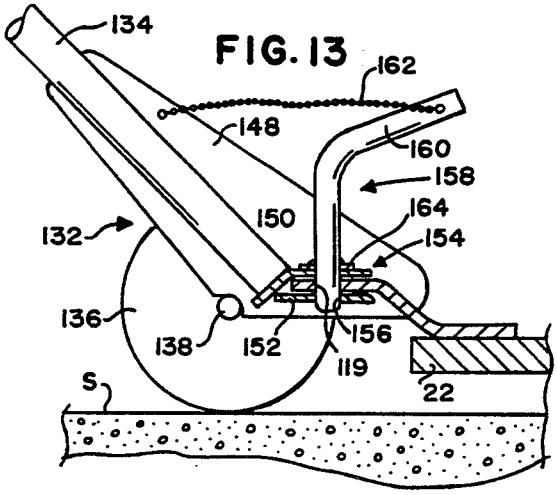
FIG. 13 is a partial side sectional view of the towing dolly of the present invention, showing engagement with the towing bracket and taken substantially along the line 13—13 shown in FIG. 12.
Figure 12:
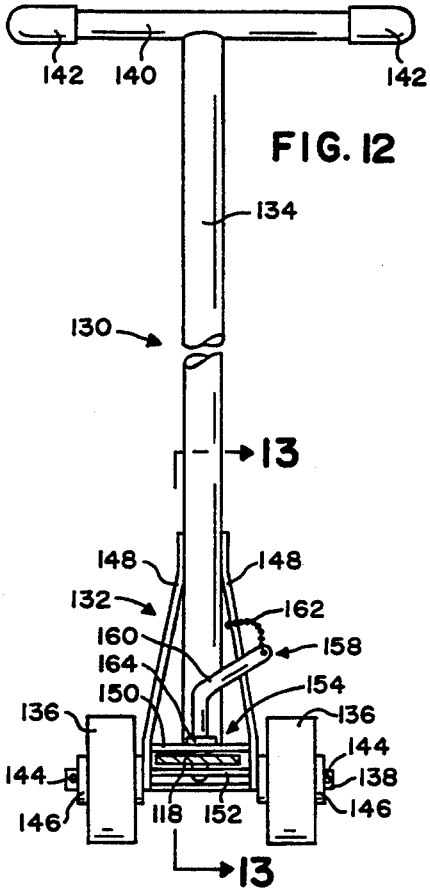
FIG. 12 is a front view of the towing dolly of the present invention showing engagement with the towing bracket, taken through a section of the towing bracket.

In the second embodiment shown in FIGS. 12 and 13, the towing means is selected to be a towing dolly 130. Towing dolly 130 includes a dolly body 132, a handle 134 securely attached to dolly body 132, as by welding, and a wheel, preferably a pair of wheels 136 on an axle 138, attached for rotation to towing dolly 130 for rolling support thereof. Handle 134 preferably includes a bar 140 secured at one end thereof remote from dolly body 132 having plastic or rubber handgrips 142. Wheels 136 are retained on axle 138 by securing means such as cotter pins 144 and washers 146.

Dolly body 132 is preferably constructed of a pair of side plates or gussets 148, welded to the sides of handle 134 and bendingly spaced apart to provide a closely mating fit with the sides of towing bracket 118, thereby preventing swiveling of dolly body 132 with respect to towing bracket 118 when the two are engaged as hereinafter described. Two plates, 150 and 152, are welded to and spacingly separate gussets 148, forming a clevis 154 having a hole 156 therethrough for mating alignment with hole 119 in towing bracket 118.

Towing dolly 130 also includes securing means 158, such as pin 160, for securing towing bracket 118 to clevis 154 through holes 156 and 119, respectively, in clevis 154 and towing bracket 118. Pin 160 may be chained to gusset 148 as by chain 162 to prevent misplacement of pin 160. Pin 160 also preferably has a collar or washer 164 welded thereto for contacting plate 150 to prevent pin 160 from dropping completely through holes 156 and 119 in a manner that will now be understood.

In practice, wheel means 84 will supportingly raise lift 20 from surface S when lift 20 is in the lowered position with no vehicle thereon, then the selected towing means will be attached to a towing bracket 118, and lift 20 will be pulled out of one garage bay. The towing means may then be removed, reattached to the other towing bracket 118, and lift 20 can be pulled to another garage bay and the towing means detached. Once in position, wheel means 84 will be retracted, lift 20 will rest upon garage surface S, and the lift may be used. It should be noted that the central location of wheel means 84 on each opposite side 88 of lift 20 balances the load of the lift and makes it easy to steer lift 20 as it is moved from one garage bay to another.

Although the present invention has been described and illustrated with respect to a preferred embodiment and a preferred use therefor, it is not to be so limited since modifications and changes can be made therein which are within the full intended scope of the invention.

I claim:

1. In combination, a portable surface lift for a vehicle and a pair of manually retractable wheel means respectively attached to a mid-portion of opposite sides of said lift for rolling movement of said lift over a surface, each said wheel means comprising:

(a) an arm having a first end and a second end, said arm being pivotally attached to its respective said side of said lift between said first and said second ends, and said arm having a handgrip portion adjacent said second end; and (b) a wheel rotatably attached to said first end;

said arm having a wheel-retracted position in which said lift rests on said surface and having a wheel-extended position in which said wheel is in contact with said surface and said wheel means supportingly raises said lift from said surface for said rolling movement thereover; when said arm is in said wheel-retracted position, said handgrip portion of each said arm being vertically offset from said surface by a first bended region in said arm between said handgrip portion and said pivotal attachment of said arm to its respective said side of said lift, and the handgrip portion of each said arm being horizontally offset from said lift by a second bended region in said arm between said handgrip portion and said pivotal attachment of said arm to its respective said side of said lift.

2. The lift as recited in claim 1, in which said lift includes manual towing means, removably attachable to an end of the lift, for causing the lift to be rollingly moved by manual towing or pushing.

* * * * *